US010780725B2

(12) United States Patent
Huotari

(10) Patent No.: US 10,780,725 B2
(45) Date of Patent: Sep. 22, 2020

(54) END PAPER ARRANGEMENT AND METHOD FOR FORMING THE FRONT AND BACK END PAPER OF A BOOK

(71) Applicant: FASTBIND MAPING OY, Espoo OT (FI)

(72) Inventor: Henri Huotari, Espoo (FI)

(73) Assignee: Fastbind Maping Oy, Espoo (FI)

( * ) Notice: Subject to any disclaimer, the term of this patent is extended or adjusted under 35 U.S.C. 154(b) by 0 days.

(21) Appl. No.: 16/026,349

(22) Filed: Jul. 3, 2018

(65) Prior Publication Data

US 2019/0047314 A1 Feb. 14, 2019

(30) Foreign Application Priority Data

Jul. 5, 2017 (EP) ..... 17179763
Sep. 9, 2017 (EP) ..... 17190259

(51) Int. Cl.

| | |
|---|---|
| ***B42C 19/00*** | (2006.01) |
| ***B42C 9/00*** | (2006.01) |
| ***B42D 1/02*** | (2006.01) |
| ***B42D 3/00*** | (2006.01) |

(52) U.S. Cl.

CPC ..... *B42C 19/00* (2013.01); *B42C 9/0006* (2013.01); *B42C 9/0056* (2013.01); *B42D 1/02* (2013.01); *B42D 3/002* (2013.01)

(58) Field of Classification Search

None

See application file for complete search history.

(56) References Cited

U.S. PATENT DOCUMENTS 3,292,951 A 12/1966 Schoenberger
3,330,718 A * 7/1967 James, Jr. ..... B42C 11/045 156/554
5,066,182 A * 11/1991 Stonebraker ..... B42B 5/00 281/21.1
5,183,294 A * 2/1993 Jukola ..... B42C 9/0068 281/23

(Continued)

FOREIGN PATENT DOCUMENTS

FI 791516 12/1980

OTHER PUBLICATIONS

European Search Report in application EP17190259.6, dated Feb. 27, 2018, EPO.
Written Opinion, dated Aug. 29, 2018 PCT/IB2018/054688.

*Primary Examiner* — David R Dunn
*Assistant Examiner* — Christopher E Veraa
(74) *Attorney, Agent, or Firm* — Bourque & Associates

(57) ABSTRACT

An end paper arrangement and method for forming the front and back end paper of a book wherein the end paper arrangement comprises an inner sheet and outer sheet which are fastened on one side against each other over at least one area so that an unfastened area remains between the fastened areas. The unfastened area forms a tunnel for the spine of the book. On that side of the inner sheet which is opposite to the fastened side there is an adhesive surface on both edge parts, and there is an adhesive-free area between the adhesive surfaces. On the side of the outer sheet which is opposite to the fastened side, there is an adhesive surface on both edge parts, and there is an adhesive-free area between the adhesive surfaces. The method performs the assembly set forth in the arrangement.

13 Claims, 11 Drawing Sheets

23

(56) References Cited

U.S. PATENT DOCUMENTS

| | | | | |
|---|---|---|---|---|
| 5,702,219 | A * | 12/1997 | Hattori | B42C 9/0018 412/1 |
| 6,402,450 | B1 * | 6/2002 | Kritzinger | B42C 19/02 270/4 |
| 6,709,727 | B1 * | 3/2004 | Parker | B42C 9/0056 412/3 |
| 6,866,459 | B2 * | 3/2005 | Cobene | B42C 11/04 270/52.08 |
| 2004/0066029 | A1 * | 4/2004 | Parker | B42C 11/04 281/4 |
| 2006/0182520 | A1 * | 8/2006 | Shibuya | B42C 11/04 412/8 |
| 2006/0198719 | A1 * | 9/2006 | Parker | B42C 11/04 412/4 |
| 2008/0197617 | A1 * | 8/2008 | Kobayashi | B42C 17/00 281/21.1 |
| 2013/0233928 | A1 * | 9/2013 | Ghisa | B42D 1/003 235/488 |

* cited by examiner

23

END PAPER ARRANGEMENT AND METHOD FOR FORMING THE FRONT AND BACK END PAPER OF A BOOK

FIELD OF INVENTION

The invention is related to the field of bookbinding.

TECHNICAL BACKGROUND

Patent application publication US 2006/0182520 A1 discloses one way of implementing the spine of a book by using a tubular structure. A front and back end paper are formed in a book.

A similar structure has been used for example in the Finnish patent 61429 of publishing company Kustannusyhtiö Otava. The structure presented in said Finnish patent has been developed further in the manner described in the U.S. Pat. No. 5,183,294. A front and back end paper are also formed in these books.

FIG. 1 presents a method known by the applicant to implement the back and front end paper of a book by means of an end paper arrangement 10. The left end paper sheet 1 and the right end paper sheet 2 are connected to each other through the spine area 3. The left end paper sheet 1 forms the front end paper and the right end paper sheet 2 forms the back end paper, when the end paper arrangement 10 is fastened to a bundle of sheets fastened to each other. The end paper arrangement 10 does not contain any ready-made adhesive surfaces. Using the technique presented in FIG. 1, the front end paper and back end paper (which are sometimes referred to by the English professional term end paper) of a book are glued from a folded sheet, which can be freely of a similar paper tone as the contents. The front end paper and back end paper can be printed either on a large sheet or on a small sheet, but this has no relevance in terms of the selection of the paper, because the end paper arrangement does not contain an adhesive sheet.

When using an end paper arrangement like the one in FIG. 1, where the end papers are folded like the applicant's Fastbind® Endpaper, the problem is that the product in question must be in the stock of the printing house. The end paper arrangement has been made in advance elsewhere at the factory, while in the conventional bookbinding method the printing house itself also makes the front end paper and back end paper and glues it in its own process.

FIG. 2 presents a second method known by the applicant to implement the back and front end paper of a book by means of an end paper arrangement 11. Unlike in the end paper arrangement the end paper arrangement 11 also contains label adhesive 4, the label adhesive surfaces of which are protected by means of silicon coated i.e. siliconised paper 5. The end paper arrangement 11 can optionally also contain adhesive 6 inside the fold of the left end paper sheet 1 and right end paper sheet 2, which enables the use of the end paper arrangement 11 in an automatic bookbinding device.

FIG. 3 presents a third method known by the applicant to implement the back and front end paper of a book by means of an end paper arrangement 12. Unlike in the end paper arrangement the end paper arrangement 12 contains an area 7 with no label adhesive underneath siliconised paper 5, which area 7 enables an easier peeling off of the siliconised paper 5. In this case, the flap 8 can optionally extend over the spine part 3, in which case it is even easier to remove the siliconised paper 5.

FIG. 4 presents the use of the end paper arrangement 11. Fastening material 16—most preferably adhesive such as PUR adhesive of EVA hot melt—is used for fastening a bundle 15 of sheets fastened to each other to the end paper arrangement 11. When fastening the sheets of the bundle 15 to each other, the fastening material 16 is advantageously adhesive taken to the spine edge of the bundle 15, such as PUR adhesive of EVA hot melt. It is clear that instead of the end paper arrangement 11, end paper arrangement 10 or 12 can also be used.

FIG. 5 presents a book block 20, which has been formed when the left end paper sheet 1 and right end paper sheet 2 are fastened to the bundle 15. As FIG. 5 shows, the fastening material 16 comes directly against the spine area. The free ends of the book block 20 are trimmed by cutting (in other words, at the top edge of drawing FIG. 5, all pages of the bundle 15 and the parts of the end paper arrangement 11 would be cut to the same level T), after which the book block is fastened to the covers of the book by gluing. Gluing is carried out most easily by removing the siliconised paper 5 from both self-adhesive sheets 4 and by 5 gluing the self-adhesive sheets 4 to the covers of the book.

OBJECTIVE OF INVENTION

End paper arrangements in accordance with prior art comprise ready-made end paper sheets. For this reason, it is no longer possible to influence the material and color options of the front and back end paper, used in the forming of a book block or a complete book that comprises a front end paper and back end paper, at the place of end use of bookbinding. This restricts the use of known end paper arrangements especially in a modern digital printing environment, which would otherwise enable practically full freedom in the choice of the paper. In this case, it is necessary to keep a large number of different end paper arrangements in stock at the place of end use, which is often considered frustrating, and it also requires storage space.

The objective of the invention is to enable the manufacture of a book block that comprises a front and back end paper by using the end paper arrangement in a modern digital printing environment so that the paper grade and colour of the front end paper and back end paper can be selected at the digital printing house.

This objective can be accomplished by means of an end paper arrangement according to the independent claim 1 and by means of a method according to the parallel independent claim 5.

The dependent claims describe the preferred embodiments of the end paper arrangement and method.

Especially by using the method according to claim 7, it is possible to accomplish a strong fastening between the cover and the bundle of sheets.

Especially by using the method according to claim 10, it is possible to reduce the risk of the piercing devices coming loose from the sheets of the book and from the cover of the book when the sheets of the book are turned and when the covers of the book are opened or closed.

SUMMARY OF THE INVENTION

An end paper arrangement for the forming of the front and back end paper of a book comprises an inner sheet and outer sheet, which are fastened on their one side against each other over at least one area so that an unfastened area remains between the fastened areas, in which unfastened area the inner sheet and outer sheet form a tunnel, advantageously for the spine of the book and/or for a movement area. On that side of the inner sheet, which is opposite to the fastened side, there is an adhesive surface on both edge parts, and there is an adhesive-free area between the adhesive surfaces. On that side of the outer sheet, which is opposite to the fastened side, there is an adhesive surface on both edge parts, and there is an adhesive-free area between the adhesive surfaces.

By means of the adhesive surfaces (such as two-sided self-adhesive sheets), the end paper arrangement enables that it is now possible to use the outermost sheets in a bundle of sheets tied together as the front and back end paper. In this case, it is possible to select the material, grade and color of the front and back end paper at the place of end use of bookbinding, which enables a versatile usability of the end paper arrangement in a modern digital printing environment.

When the adhesive surfaces on the side opposite to the fastened side of the outer sheet are protected by means of a uniform protective sheet, such as siliconised paper, it is possible to expose the adhesive surfaces with one movement of the hand, thus reducing the number of hand movements needed.

When each of the adhesive surfaces on the side opposite to the fastened side of the outer sheet are protected by means of their own at least one protective sheet, such as siliconised paper, it is possible to expose the adhesive surfaces one by one, which prevents unintentional adhesion.

In accordance with an advantageous aspect, at the tunnel of the end paper arrangement, there can be an area containing hot melt on at least one side pointing away from the tunnel (in other words either in the inner sheet or in the outer sheet or in both), which area is advantageously strip-like. In this case, the end paper arrangement can be glued easily to the covers of the book and/or to a bundle of sheets fastened to each other.

In the method for the forming of the front and back end paper of a book:

- a bundle of sheets are placed over the end paper arrangement and fastened to the end paper arrangement;
- the bundle is glued from its first outermost sheet to the adhesive surface opposite to the fastened side of the inner sheet and from its second outermost sheet to the adhesive surface opposite to the fastened side of the inner sheet, which adhesive surface is on the other side of the adhesive-free area;
- the first cover of the covers of the book is glued from its inner side to the adhesive surface opposite to the side fastened to the outer sheet, and the second cover is glued from its inner side to the adhesive surface opposite to the side fastened to the outer sheet, which adhesive surface is on the other side of the adhesive-free area.

In this case, the outermost sheets of the bundle form the front and back end paper of the book.

In the first embodiment of the method, the sheets in the bundle are fastened to each other before placement over the end paper arrangement. The sheets are fastened most advantageously by gluing. Gluing can be carried out by means of hot melt, especially EVA hot melt or PUR adhesive.

In the second embodiment of the method, in addition to this or as an alternative to this, the sheets and end paper arrangement are fastened to each other after placement on top of each other by piercing by means of a number of piercing devices. In this case, the sheets are not specifically most preferably fastened to each other before placement over the end paper arrangement. The piercing devices used are for example staples.

The piercing devices are most advantageously fastened at the tunnel, best in a cross direction with respect to the direction 5 of the tunnel in the middle of the tunnel or otherwise in the center area. In this case, a movement area is advantageously formed for the piercing devices between the covers of the book and the end paper arrangement, enabling the movement of the piercing devices with respect to the covers of the book when the 10 sheets are browsed and when the covers of the book are opened or closed.

The book according to the invention is made using some method according to the invention.

BRIEF DESCRIPTION OF THE DRAWINGS

In what follows, the end paper arrangement and method are presented in more detail by means of the exemplary embodiments shown in drawings FIGS. 6-16 wherein the drawings illustrate.

The same reference numbers refer to the same technical parts in all drawings.

DETAILED DESCRIPTION

Figure 6:
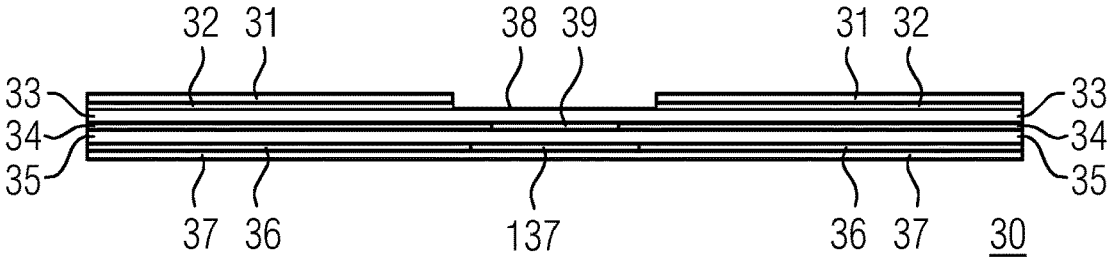
FIG. 6 shows the first embodiment of the end paper arrangement according to one embodiment of the present invention.

FIG. 6 shows an end paper arrangement 30 for the forming of the front and back end paper of a book. The end paper arrangement 30 comprises an inner sheet 33 and an outer sheet 35, which are fastened on their one side against each other over at least one area so that an unfastened area remains between the fastened areas, in which unfastened area the inner sheet 33 and outer sheet 35 form a tunnel 39 for the spine of the book.

On that side of the inner sheet 33, which is opposite to the fastened side, there is an adhesive surface 32 on both edge 25 parts, and there is an adhesive-free area 38 between the adhesive surfaces 32.

On that side of the outer sheet 35, which is opposite to the fastened side, there is an adhesive surface 36 on both edge parts, and there is an adhesive-free area 137 between the adhesive surfaces 36.

In the end paper arrangement 30, the adhesive surfaces 36 on the side opposite to the fastened side of the outer sheet 35 are protected by means of a uniform protective sheet 37, such as siliconised paper.

Figure 7:
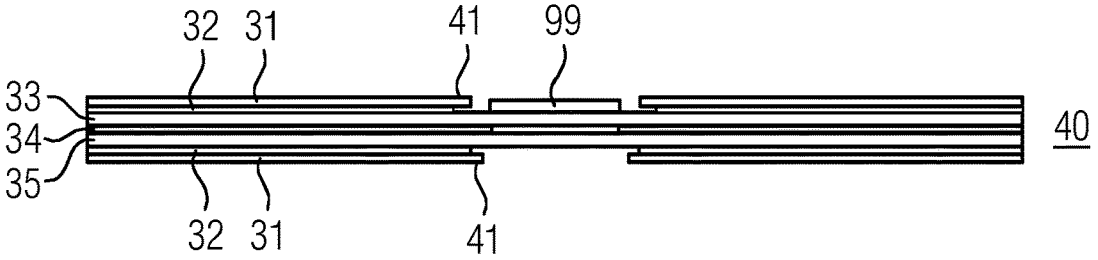
FIG. 7 shows the second embodiment of the end paper arrangement according to another embodiment of the present invention.

In end paper arrangement 40, FIG. 7 which is alternative to the end paper arrangement 30 (cf. FIG. 6), each of the adhesive surfaces 36 on the side opposite to the fastened side of the outer sheet 35 can be protected by means of their own at least one protective sheet 37, such as siliconised paper.

At the tunnel 39, there can be an area 99 containing hot melt on at least one side that points away from the tunnel 39—in other words in the position indicated by FIG. 6 or either at the adhesive-free surface 38 above the inner sheet 33 and/or at the adhesive-free surface 137 of the outer sheet 35, which area 99 containing hot melt is advantageously strip-like.

Each of the siliconised papers 37, 31 or part of them can have a flap 41.

Figure 1:
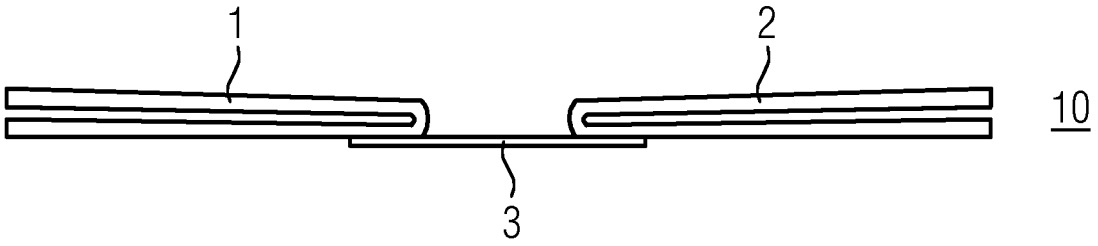
FIGS. 1-3 show different end paper arrangements known from prior art.
Figure 2:
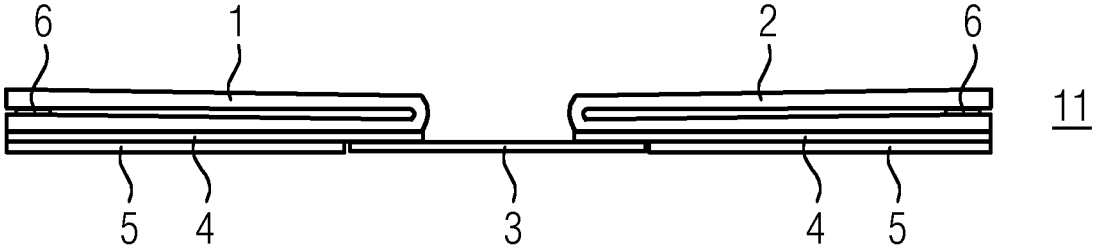
Figure 3:
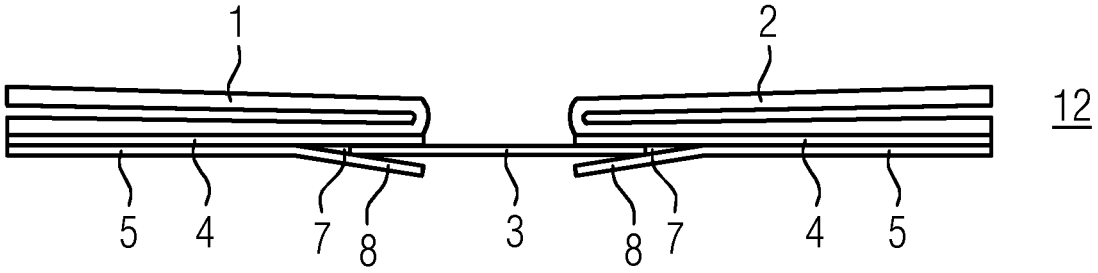
Figure 4:
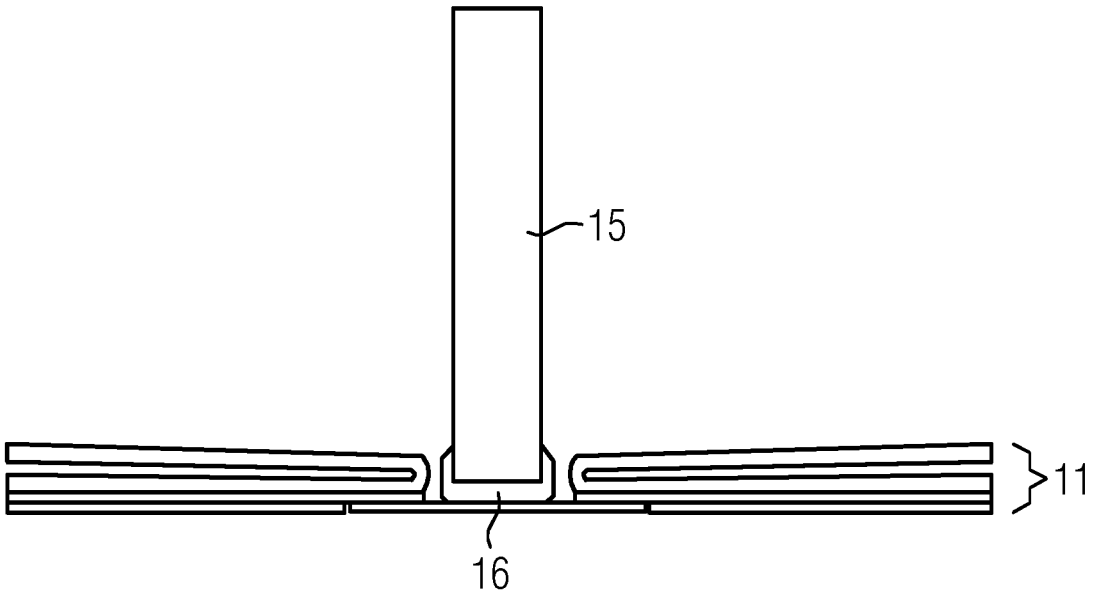
FIG. 4 shows the fastening of the end paper arrangement according to FIG. 2 to a bundle of sheets fastened to each other.
Figure 5:
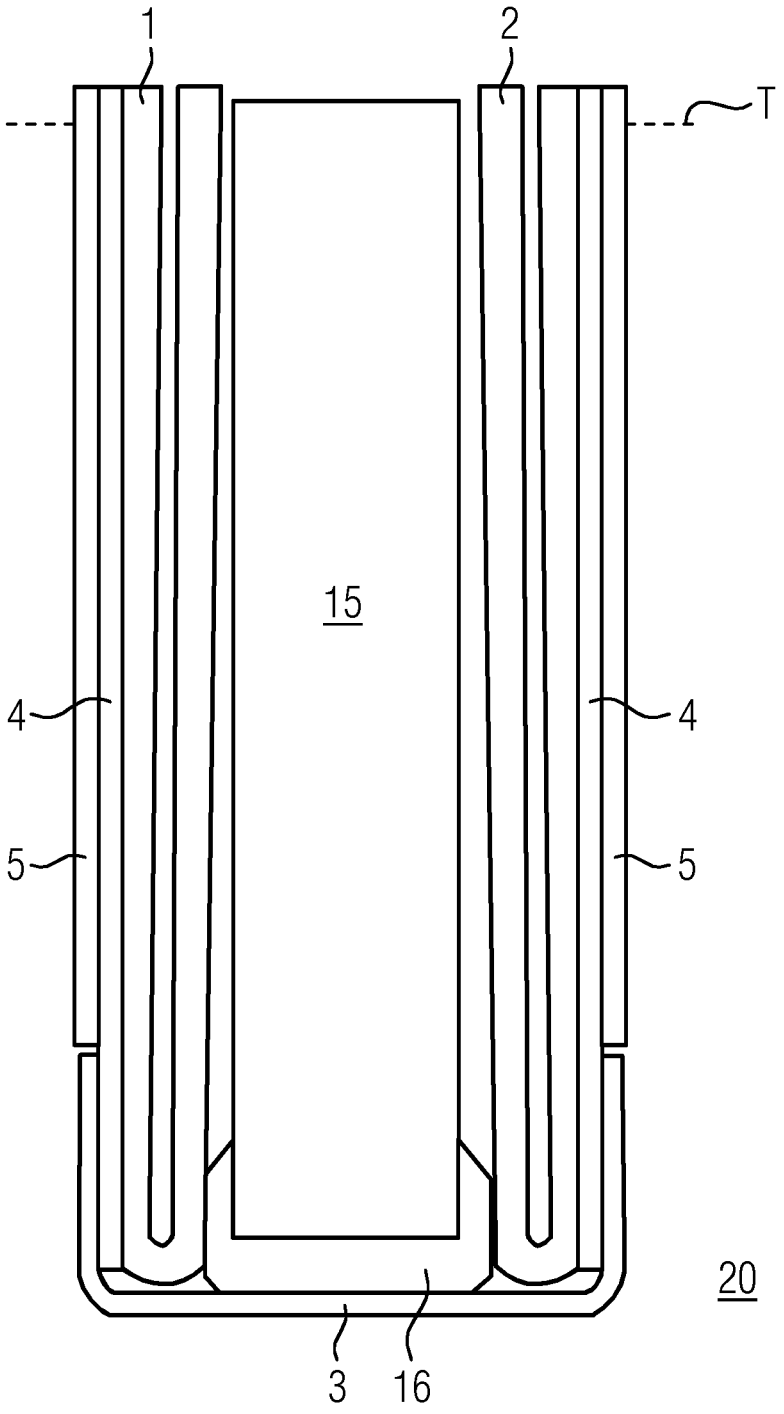
FIG. 5 shows a book block made in accordance with FIG. 4.
Figure 8:
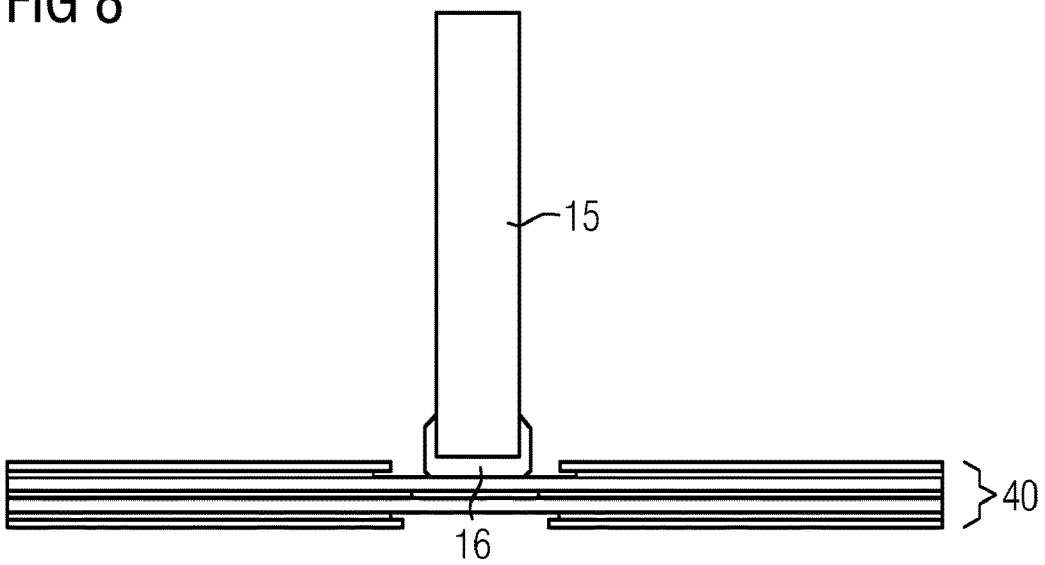
FIG. 8 shows the fastening of the end paper arrangement according to FIG. 7 to a bundle of sheets fastened to each other.
Figure 9:
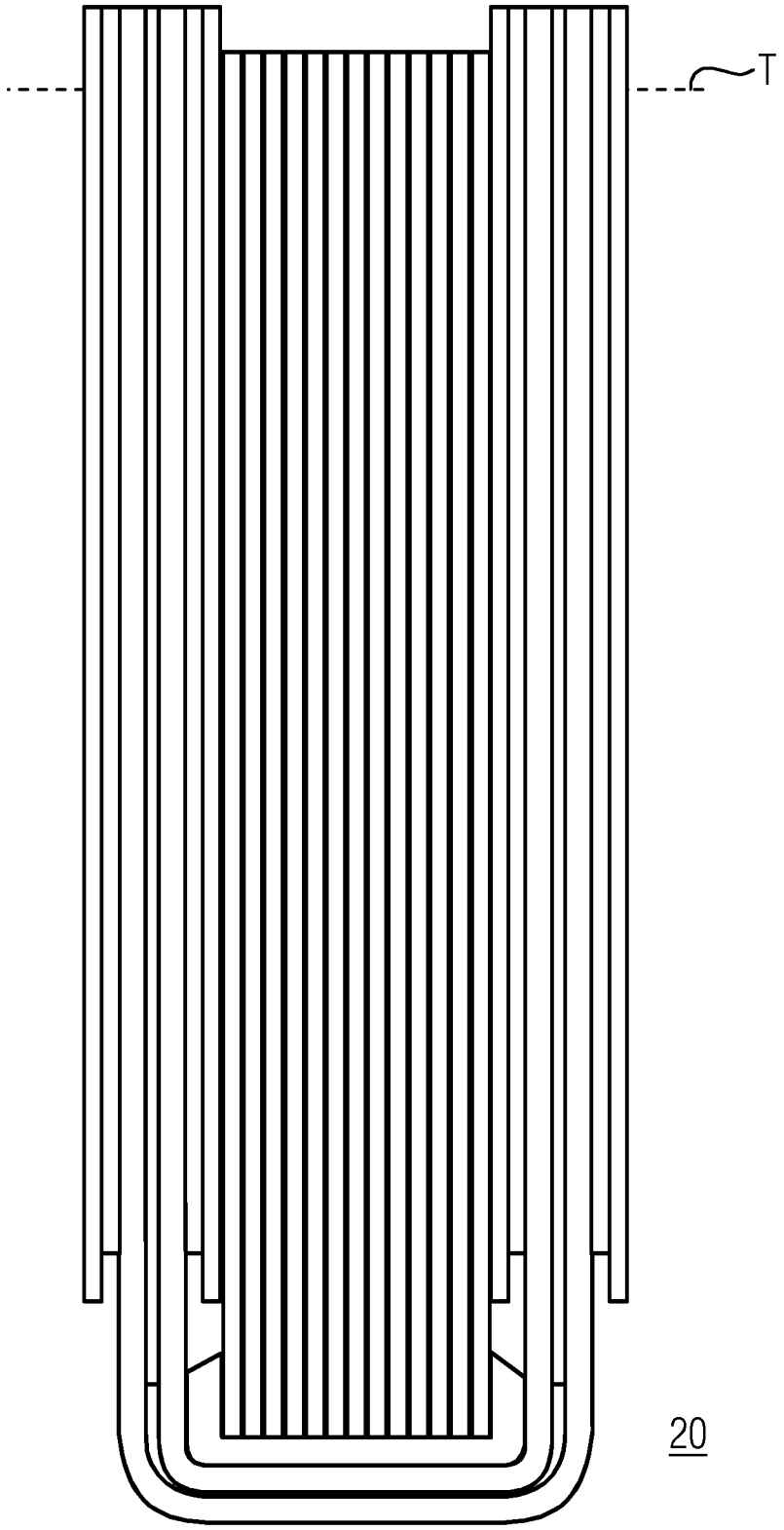
FIG. 9 shows a book block made in accordance with FIG. 8.
Figure 10:
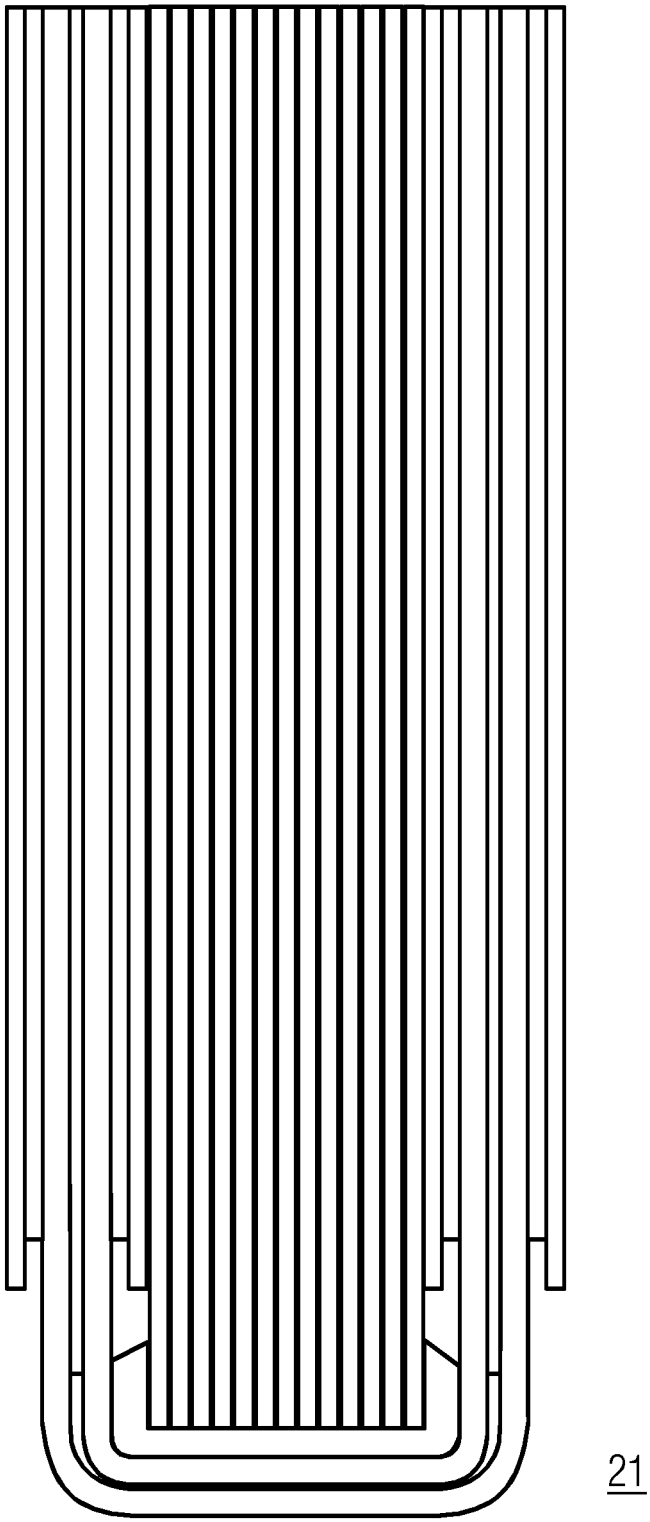
FIG. 10 shows the book block of FIG. 9 after the trimming of edges.
Figure 11:
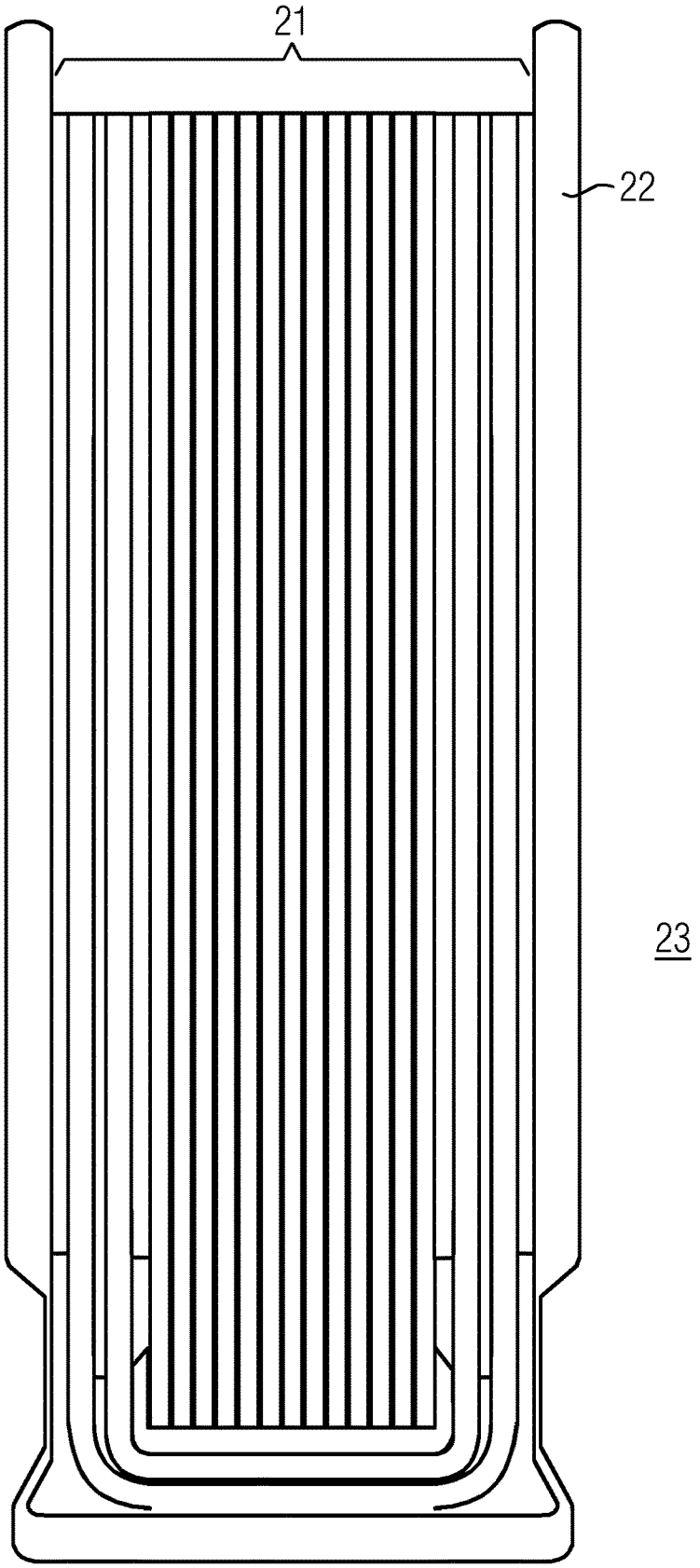
FIG. 11 shows the book block of FIG. 10 fastened to the covers of the book.
Figure 12:
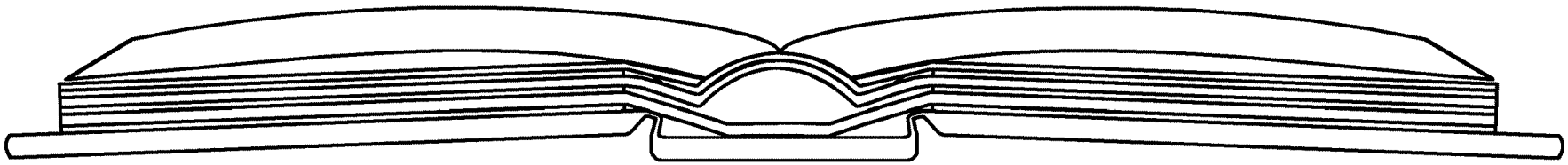
FIGS. 12 and 13 show the book of FIG. 11 when opened.
Figure 13:
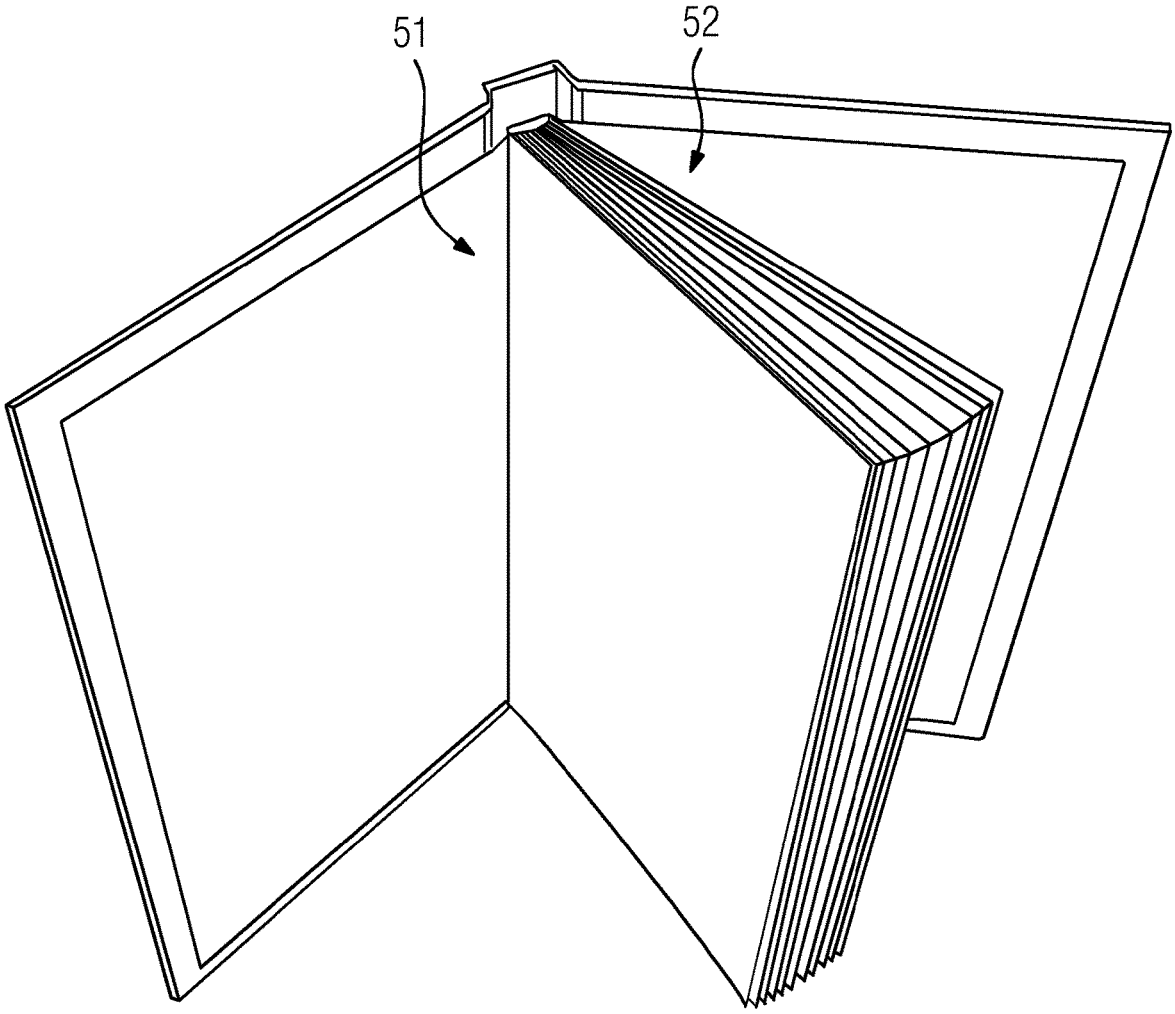

In the method for the forming of the front and back end paper of a book:

- a bundle 15 of sheets 65 are placed over the end paper arrangement 30, 40 (cf. FIG. 8 or 14) and fastened to the end paper arrangement 30, 40 (cf. FIG. 9, FIG. 15 and FIG. 16);
- the bundle 15 is glued from its first outermost sheet to the adhesive surface 32 opposite to the fastened side of the inner sheet 33 of the end paper arrangement 30, 40 and from its second outermost sheet to the adhesive surface 32 opposite to the fastened side of the inner sheet 33, which adhesive surface 32 is on the other side of the adhesive-free area 38 (cf. FIG. 9);
- the end paper arrangement 30, 40 and the bundle 15 are trimmed to the same line T (cf. FIG. 10);
- the first cover of the covers 22 of the book is glued from its 30 inner side to the adhesive surface 36 opposite to the side fastened to the outer sheet 35, and the second cover is glued from its inner side to the adhesive surface 36 opposite to the side fastened to the outer sheet 35, which adhesive surface 36 is on the other side of the adhesive-free area 137 (cf. FIG. 11);
  - in which case the outermost sheets of the bundle 15 form the front end paper 51 and back end paper 52 of the book 23 (cf. FIG. 5 13). In the book 23, there is a space for movement at the spine edge of the covers 22 and bundle 15 thanks to the end paper arrangement 30, 40. This prevents the tearing off of the bundle from the covers 22 and enables the manufacture of high-quality hardbound books 23 so that the front end paper 51 and back end 10 paper 52 can be printed at the place of use using a freely selectable and printable grade, material and colour.

According to the first embodiment of the method, the sheets 65 in the bundle 15 are fastened to each other before placement over the end paper arrangement 30, 40. The sheets 65 are fastened to each other most advantageously by gluing, most preferably by means of hot melt such as EVA hot melt or PUR adhesive.

In addition to this, the sheets 65 and end paper arrangement 30, 40 can be fastened to each other after placement on top of each 20 other by piercing by means of a number of piercing devices 64.

Figure 16:
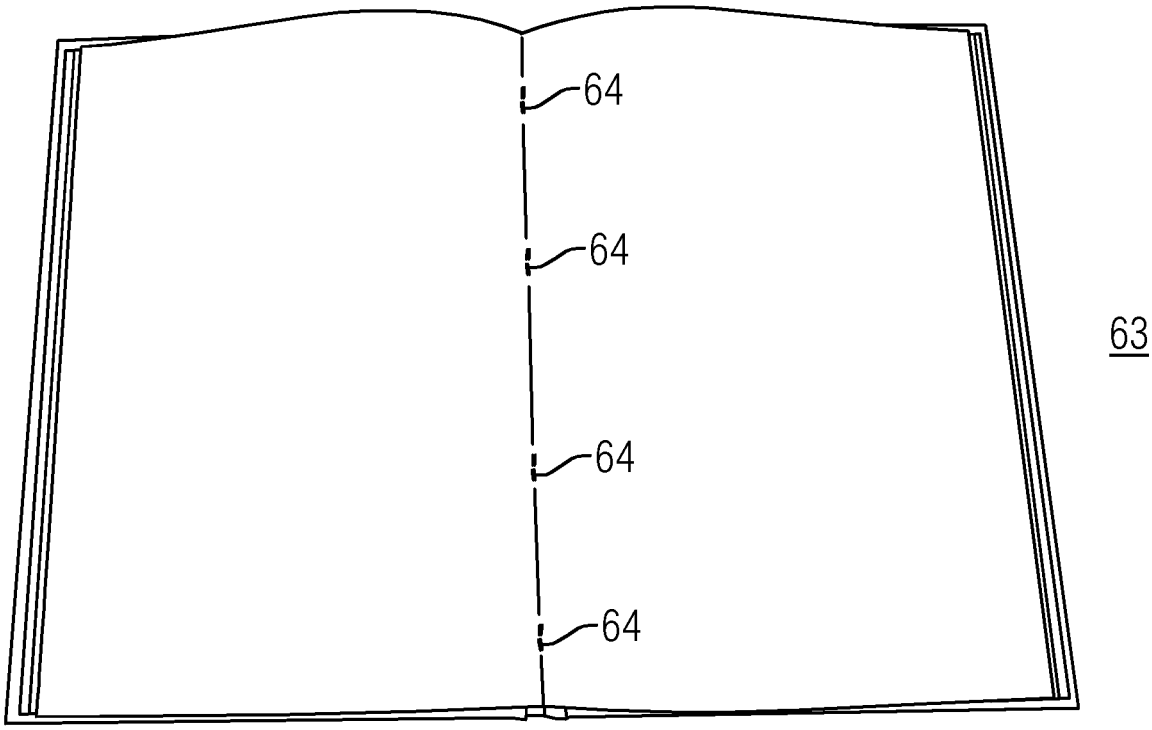

According to the second embodiment of the method according to the present invention, the sheets 65 in the bundle 15 are not yet fastened to each other when placed over the end paper arrangement 30, 40, but the fastening to each other is only carried out after the placement of the sheets 65 and end paper arrangement 30, 40 on top of each other by piercing by means of a number of piercing devices 64 (see FIG. 16).

The piercing devices 64 used are best staples. The staples are stapled most preferably in the direction of the tunnel 39. The sheets 65 can be folded with respect to the center line of the book 63, in which case the staples are best stapled to the folding line.

The piercing devices 64 are most preferably fastened at the tunnel 39, most advantageously in a cross direction with respect 35 to the direction of the tunnel 39 in the middle of the tunnel 39 or otherwise in the center area. In this case, a movement area 66 is formed for the piercing devices 64 between the covers 22 of the book 63 and the end paper arrangement 30, 40, enabling the movement of the piercing devices with respect to the covers 22 of the book when the sheets 65 are browsed and when the covers 22 of the book 63 are opened or closed. When the book 63 is browsed, the tunnel 39 reduces the stresses exerted on the adhesive bonding (label adhesive 36) between the cover 22 and outer sheet 35.

Figure 14:
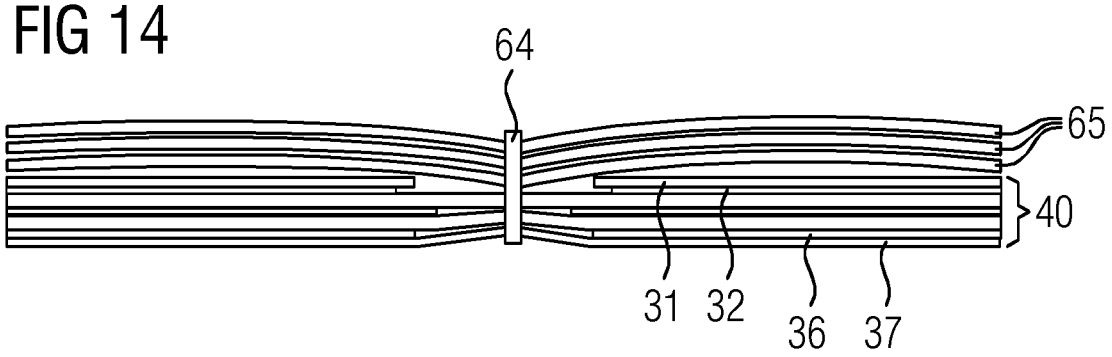
FIGS. 14-16 show an alternative embodiment of the method according to the present invention, wherein the sheets and end paper arrangement are fastened to each other after placement on top of each other by piercing by means of a number of piercing devices.
Figure 15:
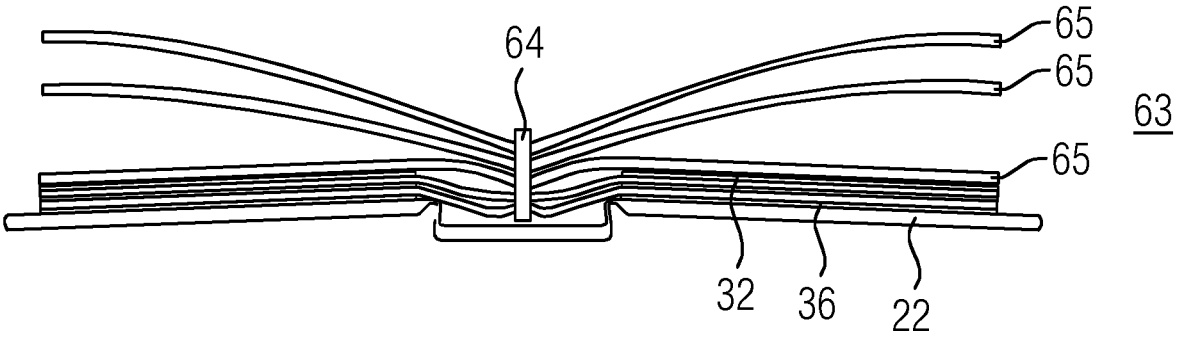

FIG. 14 and FIG. 15 present that the book 63 has three sheets 65. In practice, the number of the sheets 65 can be other than 3. The book 63 can have at least two sheets 65 (for example if the book 63 is a restaurant menu), but there can be more sheets 65, for example 3 to 20 sheets.

The invention should not be understood to be limited only by the below claims, but the invention is to be understood to include all their legal equivalents and the combinations of the embodiments presented.

REFERENCE NUMBERS USED

1 left end paper sheet
2 right end paper sheet
3 spine area
4 label adhesive
5 siliconised paper
10 end paper arrangement
11 end paper arrangement
12 end paper arrangement
15 bundle of sheets fastened together
16 fastening material, most advantageously adhesive
20 book block
21 inner part of book
22 cover part of book
23 book
30 end paper arrangement
31 siliconised paper
32 label adhesive
33 inner sheet
34 inner sheet
35 outer sheet
36 label adhesive
37 siliconised paper
38 adhesive-free surface of inner sheet
39 tunnel
40 end paper arrangement
41 flap
51 front end paper
52 back end paper
63 book
64 staple
65 sheet
66 movement area
99 area containing hot melt
137 adhesive-free surface of outer sheet'

Modifications and substitutions by one of ordinary skill in the art are considered to be within the scope of the present invention, which is not to be limited by the allowed claims and their legal equivalents.

The invention claimed is:

1. An end paper arrangement (30, 40) for the forming of the front and back end paper (51, 52) of a book (23, 63), the end paper arrangement comprising:

an inner sheet (33) and outer sheet (35) which are fastened on a respective first side against each other over at least one area (34) so that an unfastened area remains between the at least one fastened areas (34) of said inner sheet (33) and outer sheet (35), and wherein the unfastened area between the inner sheet (33) and the outer sheet (35) forms a tunnel (39), wherein on a second side of the inner sheet (33) which is opposite to the first fastened side, there is an adhesive region (32) along first and second edges of said second side of the inner sheet (33), and an adhesive-free area (38) between the adhesive regions (32) on said second side of the inner sheet (33) which is opposite to the first fastened side; and wherein on a side of the outer sheet (35) which is opposite to the fastened side, there are one or more adhesive regions (36) along first and second edges of said second side of the outer sheet (35), and wherein there is an adhesive-free area (137) between the one or more adhesive regions (36).

2. The end paper arrangement (30) according to claim 1, wherein the one or more adhesive regions (36) on the side opposite to the fastened side of the outer sheet (35) are protected by means of a single protective sheet of siliconised paper (37).

3. The end paper arrangement (40) according to claim 1, where each of the one or more adhesive surfaces (36) on the side opposite to the fastened side of the outer sheet (35) are protected by means of separate protective sheets of siliconised paper (37) for each said one or more adhesive surfaces (36).

4. The end paper arrangement (30, 40) according to claim 1, wherein the tunnel (39) includes an area containing a strip-like region of hot melt on at least one side pointing away from the tunnel.

5. A method for the forming of the front and back end paper (51, 52) of a book (23, 63) utilizing the end paper arrangement (30, 40) according to claim 1, said method comprising the acts of:

placing a bundle (15) of sheets (65) over the end paper arrangement (30, 40) and fastening said bundle (15) of sheets (65) to the end paper arrangement (30, 40);

gluing the bundle (15) of sheets (65) from a first outermost sheet of said bundle (15) of sheets (65) to the adhesive region (32) along a first edge of said second side of the inner sheet (33) opposite to the fastened side of the inner sheet (33) of said bundle (15) of sheets (65) of the end paper arrangement (30, 40), which adhesive region (32) is on a first side of the adhesive-free area (38), and gluing the bundle (15) of sheets (65) from a second outermost sheet to the adhesive portion (32) along a second edge of said second side of the inner sheet (33) opposite to the fastened side of the inner sheet (33), which adhesive surface (32) is on a second side of the adhesive-free area (38);

gluing an inner surface of a first cover (22) of the book to the adhesive surface (36) opposite to the side fastened to the outer sheet (35) on a first side of the adhesive-free area (137), and gluing an inner surface of a second cover (22) to the adhesive surface (36) opposite to the side fastened to the outer sheet (35), which adhesive surface (36) is on a second side of the adhesive-free area (137) opposite said first side of said adhesive-free area (137), and wherein the outermost sheets of the bundle (15) of sheets (65) form the front and back end paper of the book (23, 63).

6. The method according to claim 5, wherein the end paper arrangement (30, 40) and the bundle (15) are trimmed to the same line (T).

7. The method according to claim 5, wherein individual sheets (65) in the bundle (15) of sheets (65) are fastened to each other before placement over the end paper arrangement (30, 40).

8. The method according to claim 7, wherein the individual sheets (65) in the bundle (15) of sheets (65) are fastened to each other by gluing.

9. The method according to claim 8, wherein the step of gluing is carried out utilizing a hot melt adhesive.

10. The method according to claim 5, wherein the individual sheets (65) in the bundle (15) of sheets (65) are fastened to each other after placement on top of each other by piercing by means of a number of piercing devices (64).

11. The method according to claim 10, where the piercing devices (64) are staples.

12. The method according to claim 10, wherein the piercing devices (64) are fastened at the tunnel (39), in a cross direction with respect to a longitudinal direction of the tunnel (39).

13. The method according to claim 12, wherein a movement area (66) is formed for the piercing devices (64) between the covers (22) of the book (63) and the end paper arrangement (30, 40), enabling the movement of the piercing devices with respect to the covers (22) of the book when the sheets (65) are browsed and when the covers (22) of the book are opened or closed.

* * * * *